US005931144A

United States Patent [19]

Firey

[11] Patent Number: 5,931,144

[45] Date of Patent: Aug. 3, 1999

[54] COMPENSATOR FOR MANIFOLD FUEL INJECTORS

[76] Inventor: Joseph C. Firey, P.O. Box 15514, Seattle, Wash. 98115-0514

[21] Appl. No.: 09/182,017

[22] Filed: Oct. 29, 1998

[51] Int. Cl.[6] ..... F02M 69/16; F02D 41/14

[52] U.S. Cl. ..... 123/681; 123/457; 123/458; 123/687

[58] Field of Search ..... 123/430, 457, 123/458, 496, 679, 681, 687

[56] References Cited

U.S. PATENT DOCUMENTS 4,425,892 1/1984 Firey ..... 123/430
5,456,232 10/1995 Firey ..... 123/430
5,483,937 1/1996 Firey ..... 123/435
5,613,475 3/1997 Firey ..... 123/496

*Primary Examiner*—Tony M. Argenbright

[57] ABSTRACT

A compensator is described for use on those manifold fuel injectors for gasoline engines which utilize a gas pressure cycler to vary the instantaneous rate of liquid fuel injection in proportion to the instantaneous rate of engine intake air flow into each engine cylinder during each intake stroke. The compensator adjusts liquid fuel injection pressure by bleeding adjustable air quantities out of the gas pressure cycler during pressure rise, and then subsequently returning these bleed masses into the gas pressure cycler during pressure decrease. A compensator of this invention is of relatively simple mechanical design, and uses a moderately complex electronic controller.

9 Claims, 3 Drawing Sheets

COMPENSATOR FOR MANIFOLD FUEL INJECTORS

BACKGROUND OF THE INVENTION

1. Field of the Invention

This invention is in the field of fuel injection systems for internal combustion engines, wherein the fuel is injected into the engine intake manifold.

2. Description of the Prior Art

The prior art of four stroke cycle internal combustion engines, using intake manifold fuel injectors, is described in U.S. Pat. No. 5,456,232, Col. 1, line 57, through Col. 4, line 15, and this material is incorporated herein by reference thereto. Some types of intake manifold fuel injectors proportion the instantaneous fuel injection rate to the instantaneous air flow rate, during each engine intake process, so that the resulting engine intake air-fuel mixture is essentially of a constant fuel to air ratio throughout the air mass quantity going into each engine cylinder during each intake process. An example of such a gasoline engine fuel injection system is described in U.S. Pat. No. 5,456,232, Col. 4, line 35, through Col. 19, line 9, and this material is incorporated herein by reference thereto. These manifold fuel injectors of U.S. Pat. No. 5,456,232, are described therein as useable on four stroke cycle internal combustion engines, but are also useable on two stroke cycle internal combustion engines, by setting the timing of fuel injection to coincide with the timing of air intake flow, during each engine air intake process.

Manifold fuel injector systems need compensator schemes, when engine speed and load vary over a wide range. Examples of prior art compensators, for manifold fuel injectors are described in the following references:

A. U.S. Pat. No. 5,456,232; Col. 13, line 40, through Col. 18, line 51:

B. U.S. Pat. No. 5,483,937

C. U.S. Pat. No. 5,613,475

These compensator schemes are relatively complex mechanically. It would be beneficial to have available a compensator scheme capable of adequately compensating a manifold fuel injector over a wide range of engine speed and load, of relative mechanical simplicity.

SUMMARY OF THE INVENTION

The compensators of this invention are intended to be used on those gasoline engine manifold fuel injectors which use a gas pressure cycler to vary the liquid fuel injection pressure, and thus vary the instantaneous liquid fuel flow rate in proportion to the instantaneous engine intake air flow rate into each engine cylinder during each intake stroke. Examples of such manifold fuel injectors are described in U.S. Pat. No. 5,456,232. Each compensator comprises at least one bleed volume and each bleed volume is connected into the variable volume chamber of the gas pressure cycler via a separate orifice and bleed valve and driver for opening and closing the valve. Each bleed volume is additionally and separately connected into the variable volume chamber of the gas pressure cycler via a return flow passage, with a check valve permitting flow only from the bleed volume into the variable volume chamber. A controller is used responsive to a sensor of engine intake air mass per intake stroke, and a sensor of gas pressure cycler pressure rise, and operates upon the drivers of the bleed valves so that the bleed valves are opened only during the pressure rise portion of the cycle of pressure rise and pressure decrease of the gas pressure cycler. The controller adjusts the number of times the bleed valve is opened, and also the duration of each valve opening, so that the mass of air bled out of the variable volume chamber of the gas pressure cycler during pressure rise is increased as engine intake air mass decreases, and is decreased as this air mass increases. During the pressure decrease portion of the gas pressure cycler cycle, the bled mass of air is returned into the variable volume chamber to maintain an essentially symmetrical cycle of pressure rise and decrease, in conformity with the essentially symmetrical engine intake air flow rate rise and decrease during each intake stroke. In this way the compensator of this invention adjusts liquid fuel injection pressure, and hence instantaneous liquid fuel flow rate, to be proportional to instantaneous engine intake air flow rate. Thus an essentially constant mixture ratio of air to fuel is maintained throughout each intake mixture mass for each engine cycle. The compensators of this invention are of greater mechanical simplicity than prior art compensators for these manifold fuel injectors and this is a principal beneficial object of this invention.

BRIEF DESCRIPTION OF THE DRAWINGS

A schematic diagram of a compensator of this invention is shown on a manifold fuel injector and gasoline engine in FIG. 1.

A detailed drawing of one form of manifold fuel injector is shown in FIG. 2 with a compensator of this invention.

Figure 3:
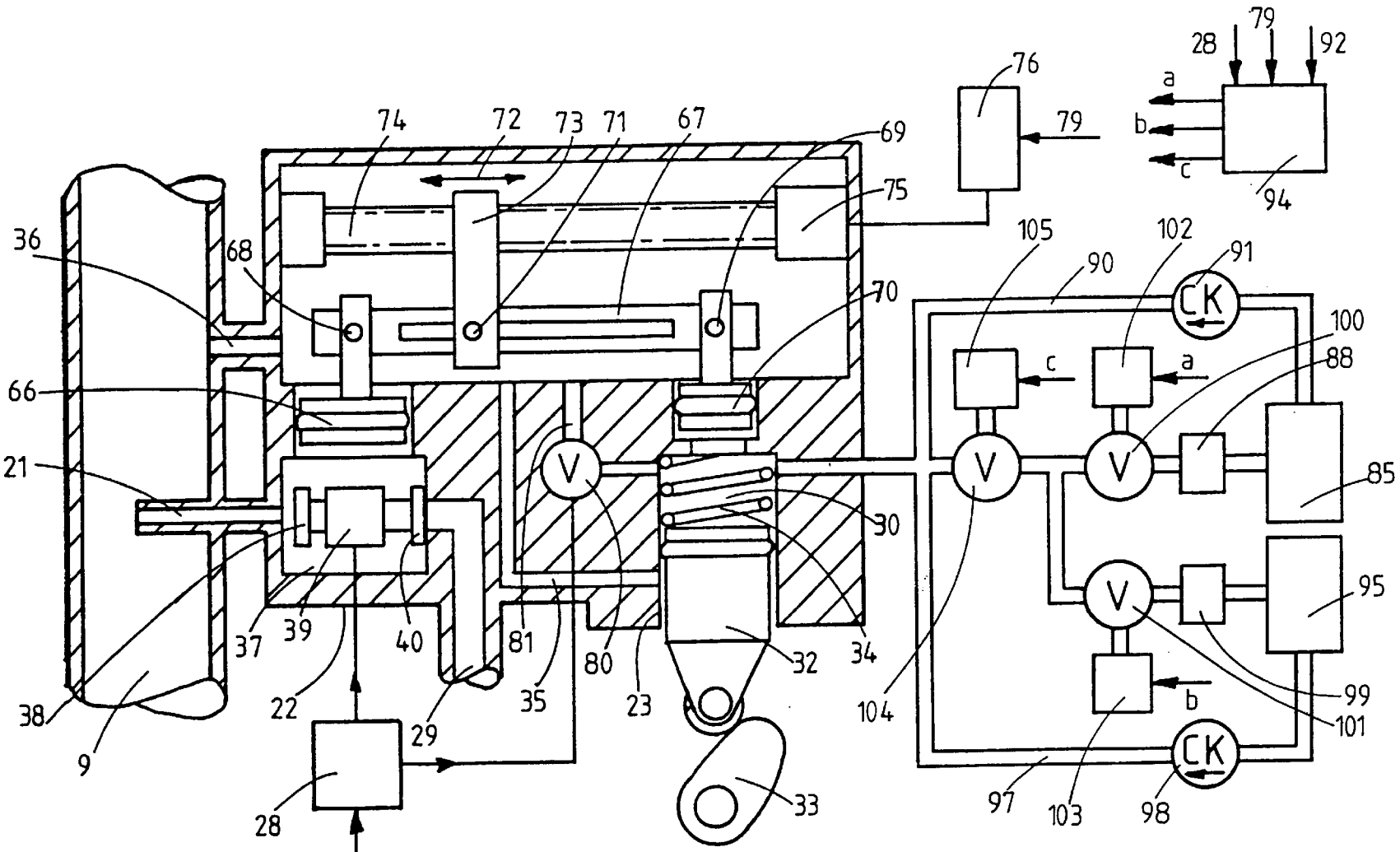

A modified form of compensator is shown in FIG. 3 on a manifold fuel injector.

DESCRIPTION OF THE PREFERRED EMBODIMENTS

Figure 1:
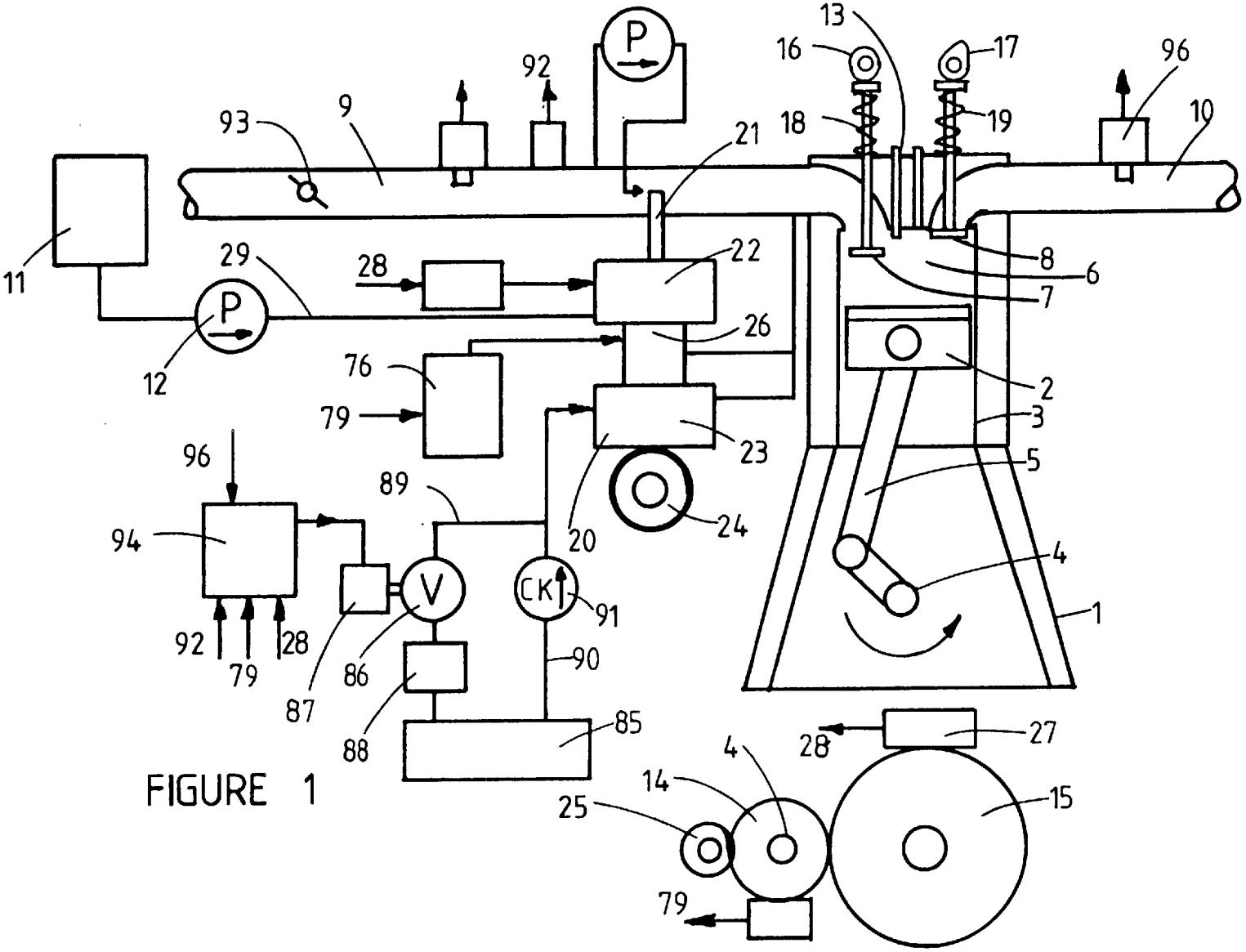

The combination of the invention described herein comprises the following three components, each of which, in turn, comprises several differing elements:

1. An internal combustion engine mechanism, as described in the material incorporated herein by reference thereto;
2. A manifold fuel injection system, as also described in the material incorporated herein by reference thereto;
3. A compensator of this invention, for the manifold fuel injection system as described herein below;

One example arrangement of the devices of this invention on a four stroke cycle internal combustion engine mechanism is shown schematically in FIG. 1 and comprises the following:

1. A four stroke cycle, single cylinder, engine, 1, is shown with piston, 2, cylinder, 3, crankshaft, 4, connecting rod, 5, variable volume chamber, 6, air intake valve, 7, exhaust valve, 8, air supply manifold, 9, exhaust gas manifold, 10, fuel supply source, 11, and fuel supply pressure pump, 12, ignition means, 13.
2. The valve drive means is shown separated from the engine for clarity and comprises: a drive gear, 14, connected to the crankshaft, 4, and rotated at crankshaft speed, a valve drive gear, 15, rotated at half crankshaft speed by the drive gear, 14, and driving in turn the intake valve cam, 16, and the exhaust valve cam, 17. The intake and exhaust valves are opened by these cams and closed by springs, 18, 19. In FIG. 1 the intake valve is shown open and the exhaust valve is shown closed with the piston descending on the intake stroke and increasing the volume of the variable volume chamber, 6, and intake air is flowing through the intake manifold, 9, and into the variable volume chamber, 6.

3. A gasoline engine manifold fuel injection system, 20, is shown in FIG. 1 and comprises:
   a. A fuel injector nozzle, 21, is injecting liquid fuel into the intake manifold, 9, whenever intake air is flowing into the engine cylinder. This liquid fuel flows from the liquid fuel chamber of the fuel injector means, 22.
   b. A gas pressure cycling means, 23, is driven by a pressure cycler drive means, 24, which is in turn driven at twice crankshaft speed from the inter drive means, 25, driven in turn from the crankshaft drive gear, 14.
   c. A pressure transmitter means, 26, transmits pressure from the gas pressure cycler, 23, to the liquid fuel chamber of the fuel injector, 22.
   d. An intake stroke sensor, 27, is one input to a fuel valve controller means, 28, which controls the opening and closing of a nozzle valve and a fuel supply valve within the fuel injector means, 22, so that: the fuel injector nozzle, 21, is connected to the liquid fuel chamber of the fuel injector, 22, only whenever air is flowing into the variable volume chamber, 6, during the intake stroke; the engine fuel supply source is connected via pipe, 29, to the liquid fuel chamber of the fuel injector, 22, only when the nozzle valve is closed.

Figure 2:
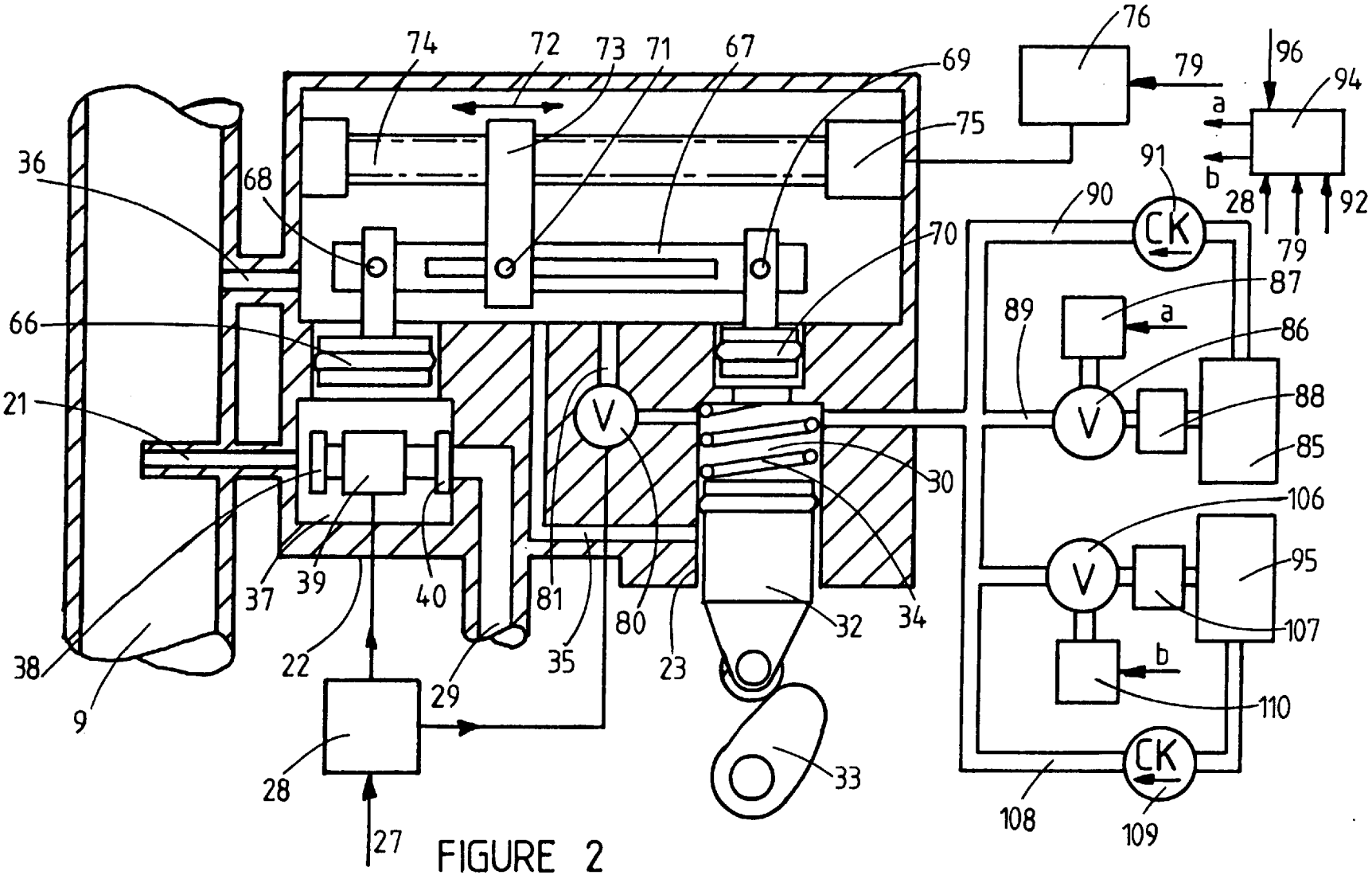

A particular example fuel injection system, 20, of this invention is shown in detail in cross section in FIG. 2 and FIG. 1 and comprises the following:

4. The gas pressure cycler, 23, comprises a variable volume chamber, 30, enclosed between the fixed cylinder container, and the moveable sealed piston, 32, which is driven by the pressure cycler drive means cam, 33, and spring, 34, driven in turn from the inter drive means, 25. When the piston, 32, is moved by the cam, 33, to decrease the volume of the variable volume chamber, 30, the gas pressure therein rises, and when the piston, 32, is moved by the spring, 34, and the cam, 33, to increase the volume of the variable volume chamber, 30, the gas pressure therein decreases. In this way a cycle of pressure increase followed by pressure decrease is created at each revolution of the pressure cycler drive cam, 33, and this cycle is timed by the inter drive means, 25, to occur during and throughout each engine intake stroke. The pressure in the variable volume chamber, 30, at the start of each pressure cycle is equalized to that in the engine air intake manifold, 9, via the vent connections, 35 and 36.
5. The fuel injector means for injecting liquid fuel, 22, into the engine intake manifold, 9, comprises a liquid fuel chamber, 37, connectable and disconnectable to the fuel injector nozzle, 21, via the nozzle valve, 38, with nozzle valve drive means, 39, and connectable and disconnectable to the fuel supply source pipe, 29, via the fuel supply valve, 40, with supply valve drive means, 39. The fuel injector nozzle, 21, connects into the engine air intake manifold, 9.

A particular example of pressure transmitter is shown in cross section in FIG. 2 and FIGS. 1, suitable for use on internal combustion engines operated over a wide range of speed and torque output, and comprises:

1. The liquid fuel pressurizer liquid piston, 66, is connected to the end, 68, of a pivoted lever, 67, whose opposite end, 69, is connected to the pressure transmitter gas piston, 70, so that the pressure created in the variable volume chamber, 30, of the gas pressure cycler, 23, is transmitted to the liquid fuel in the liquid fuel chamber, 37. The pivoted lever, 67, is pivoted about the pivot, 71, so that the force transmitted from the pressure transmitter piston, 70, to the liquid fuel pressurizer piston, 66, can be adjusted by moving the pivot, 71, in the directions, 72, relative to the ends, 69, and 68, of the lever, 67, where the gas piston, 70, and the liquid piston, 66, respectively connect to the lever, 67. When the pivot, 71, is moved toward the liquid piston, 66, the net force transmitted to the liquid fuel in the liquid fuel chamber, 37, is increased relative to the net force acting on the gas piston, 70, the reverse effect occurring when the pivot, 71, is moved toward the gas piston, 70.

In this way the ratio of net liquid pressure on the liquid fuel in the liquid fuel chamber, 37, to the net gas pressure on the gas piston, 70, can be adjusted by varying the position of the pivot, 71, relative to the liquid piston, 66, and the gas piston, 70. Also in this way the instantaneous mass rates of flow of liquid fuel can be increased by moving the pivot toward the liquid piston, 66, and away from the gas piston, 70, and vice versa. When the instantaneous mass rates of flow of liquid fuel are thusly increased or decreased the mass rate of fuel flow per intake stroke is also correspondingly increased or decreased and thus the mean value of air fuel ratio for each intake stroke can be adjusted by adjusting the position of the pivot, 71, relative to the liquid piston, 66, and the gas piston, 70.

2. An example pivot adjustment means for moving the pivot, 71, of the lever, 67, is shown in FIG. 2 and comprises: a threaded pivot holder, 73, fitted to the adjustment screw, 74, which can be rotated by the pivot drive means, 75, so that the pivot, 71, can be moved in the directions, 72, but does not move at right angles to this direction. A rotary pivot drive means, 75, is shown in this FIG. 2 example, such as an electric motor or electric stepping motor, but other pivot drive means, such as hydraulic or pneumatic drive means can alternatively be used as is well known in the art of controllers.
3. An example electronic fuel flow control means, 76, is shown in FIG. 2 which can be responsive to an engine speed sensor, 79, and operates upon the pivot drive means, 75, to adjust the position of the pivot, 71, relative to the gas piston, 70, and the liquid piston, 66. The control means, 76, operates via the pivot drive means, 75, so that the pivot, 71, is moved closer to the liquid piston when engine speed increases.

For an essentially constant mean value of air fuel ratio over a range of engine speeds, the proper relation between pivot position and engine speed is best determined experimentally.

4. The fuel valve controller, 28, receives an input signal from the intake stroke sensor, 27, and operates to open and close the nozzle valve, 38, and the fuel supply valve, 40, via their combined drive means, 39, so that the nozzle valve, 38, is open only during and throughout the intake stroke, and so that the fuel supply valve, 40, is open only when the nozzle valve is closed. The fuel valve controller, 28, also operates to close the pressure and vent valve, 80, only during and throughout the engine intake stroke, so that pressure rise is developed in the variable volume chamber, 30, of the gas pressure cycler, 23, and to open the pressure and vent valve, 80, only during and throughout the engine compression, expansion, and exhaust strokes, so that no pressure rise is developed in the variable volume chamber, 30. The pressure and vent valve, 80, vents the variable volume chamber, 30, to the engine intake manifold, 9, when open, via passages, 81, 36. The form of this invention shown in FIG. 2 can be used on a single cylinder internal combustion engine. If used on a multicylinder engine, this FIG. 2 form of the invention will require a separate gas pressure cycler, 23, for each engine cylinder. But each gas pressure cycler can serve 4 engine cylinders by use of a selector valve as described in the referenced material.

A. Basic Compensator

An example compensator of this invention, for the manifold fuel injector described hereinabove, is shown in FIG. 1, and in more detail in FIG. 2, and comprises at least the following elements:

1. At least one bleed volume, 85, inside a pressure vessel container;
2. A first bleed valve, 86, with driver, 87, for opening and closing the bleed valve;
3. A bleed orifice, 88, in the separate bleed flow passage, 89, connecting the bleed volume, 85, to the variable volume chamber, 30, of the gas pressure cycler, 23, via the first bleed valve, 86;
4. A separate return flow passage, 90, connecting the bleed volume, 85, to the variable volume chamber, 30, of the gas pressure cycler, 23, via a unidirectional flow device, 91, such as a check valve. The check valve, 91, permits flow to occur only from the bleed volume, 85, toward the variable volume chamber, 30;
5. An engine intake air mass sensor, 92, for sensing the air mass quantity going into each engine cylinder, 3, during each intake stroke. Various types of air mass sensors can be used of which the simplest is a sensor of the pressure in the engine intake manifold, 9, between the intake throttle, 93, and the engine intake valve, 7;
6. A sensor of when pressure rise is occurring in the variable volume chamber, 30, of the gas pressure cycler, 23. The piston, 32, of the gas pressure cycler, 23, is timed to decrease the volume of the variable volume chamber, 30, and thus increase the pressure, during the first half of the engine intake stroke. Thus the engine intake stroke sensor, 27, 28, is one example of such a sensor of when pressure rise will occur in the variable volume chamber, 30, of the gas pressure cycler, 23. Other types of gas pressure cycler pressure rise sensors can also be used;
7. A controller, 94, controls the opening and closing of the bleed valve, 86, by its driver, 87. The controller, 94, is responsive to the engine intake air mass sensor, 92, and the gas pressure cycler pressure rise sensor, 27, 28, so that the bleed valve, 86, is opened only when pressure rise is occurring in the variable volume chamber, 30, and further so that the product of the number of times the bleed valve, 86, is opened, multiplied by the duration of each opening during each gas pressure cycle pressure rise, increases as the air mass quantity going into each engine cylinder decreases, and decreases as the air quantity increases;
8. Various combinations of sensors, 92, 27, and controllers, 94, and valve drivers, 87, can be used, such as pneumatic or electronic. Where electronic sensors and controller are used, solenoid, or solenoid piloted, valve drivers will be preferred;

The example compensator for manifold fuel injector, shown in FIGS. 1 and 2, and described hereinabove, operates as follows when the engine, 1, is running:

9. When engine torque is decreased, as by restricting the throttle, 93, the consequently decreased engine intake manifold pressure acts via the sensor, 92, and controller, 94, to increase the product of the number of times the bleed valve, 86, is opened times the duration of each opening, during each gas pressure cycler pressure rise. As a result the pressure rise in the variable volume chamber, 30, is reduced, since more air is bled off into the bleed volume, 85, via the bleed valve, 86, and bleed orifice, 88. Hence the pressure in the liquid fuel chamber, 37, is also reduced, and the liquid fuel quantity, injected into the engine intake manifold, 9, via the fuel injector nozzle, 21, is likewise reduced. Thus as engine intake air mass is reduced the liquid fuel quantity injected into this air mass is correspondingly reduced.
10. During the latter half of the engine intake stroke, the pressure in the variable volume chamber, 30, of the gas pressure cycler, 23, is decreasing so that the ratio of instantaneous liquid fuel flow rate to instantaneous intake air flow rate can be kept within desired narrow limits. During this pressure decrease portion of the cycle of pressure rise and decrease of the gas pressure cycler, air can return flow from the bleed volume, 85, into the variable volume chamber, 30, via the check valve, 91, and return flow passage, 90. This return flow will act to maintain an approximate symmetry of the cycle of pressure rise and decrease of the gas pressure cycler, in step with the concurrent roughly symmetrical cycle of air flow rate rise and decrease during the engine intake stroke;
11. At the end of the cycle of pressure rise and decrease of the gas pressure cycler, 23, the piston, 32, uncovers the vent passage, 35, and the pressure in the variable volume chamber, 30, and also in the bleed volume, 85, is restored to engine intake manifold pressure via the passages, 35, and 36. Hence the starting pressure in the variable volume chamber, 30, and the bleed volume, 85, for the next cycle of pressure rise and decrease is always the engine intake manifold pressure;

One of the beneficial objects achievable by use of the manifold fuel injectors described in U.S. Pat. No. 5,456,232 is the creation of an intake air fuel mixture of essentially uniform fuel to air ratio throughout. By thus avoiding both over lean regions and over rich regions, the undesirable exhaust emissions originating in such regions can be minimized. Such manifold fuel injectors, when equipped with a constant mixture ratio cam, 33, create an essentially unstratified engine intake air fuel mixture, as described in U.S. Pat. No. 5,456,232.

Engine torque is varied by varying the density and pressure of the intake air, as by use of a throttle, 93, or an intake supercharger, and the liquid fuel flow must be correspondingly adjusted, in order to maintain an essentially constant overall air fuel ratio over the range of engine torque output used. Various compensator devices, for thusly adjusting the liquid fuel flow of the manifold fuel injector of U.S. Pat. No. 5,456,232, are described therein, and also in U.S. Pat. No. 5,483,937 and U.S. Pat. No. 5,613,475. The alternative compensator device of the invention described herein is mechanically simpler than these earlier compensators, and this is a principal beneficial object of this invention.

The compensator for manifold fuel injectors of this invention reduces liquid fuel flow rate, when engine intake air density, and hence pressure and mass, are reduced, by reducing the pressure generated in the gas pressure cycler, 23, and hence also reducing the pressure acting to force liquid fuel out of the liquid fuel chamber, 37, and into the engine intake manifold, 9, via the fuel injector nozzle, 21. The pressure in the gas pressure cycler is reduced by bleeding off a portion of the air mass therein into the bleed volume, the mass thusly bled off being increased when greater pressure reduction is needed. When engine intake air pressure is increased, the gas pressure cycler pressure and liquid fuel chamber pressure, are correspondingly increased by reduction of the mass bled off from the gas pressure cycler.

B. Sizing Methods

The schedule of gas pressure cycler bleed flow mass, versus engine overall air fuel ratio, over the operating range of engine torque, is preferably determined experimentally for each different engine. The following approximate relations can be used, for preliminary design purposes, for four stroke cycle engines operating at essentially constant speed:

Eqn. 1:

$$\frac{(MB)}{(MCO)} = \left[1 - \frac{[(PTR)(EF)1]^{\frac{1}{n}}}{(CRC)}\right]$$

Wherein:

(MB)=Bleed mass quantity during each pressure increase portion of the cycle of the gas pressure cycler;

(EF)=Engine factor for engine size and operating conditions;

(PTR)=Pressure transmitter pressure ratio of the manifold fuel injector;

(CRC)=Volumetric compression ratio of the gas pressure cycler;

n=Polytropic exponent for the compression process of the gas pressure cycler;

$$(EF) = \frac{(MAP)(RPM)^2}{(S)^2}$$

$$(S) = \frac{(A/fo)(60)(CfAf)(RTo)\sqrt{2gdf}}{(\pi)(VD)(ev)}$$

(A/fo)=Desired constant instantaneous air to fuel mass ratio;

Cf=Liquid fuel orifice coefficient of the manifold fuel injector;

Af=Liquid fuel orifice area;

R=Perfect gas constant for intake air;

To=Engine intake air absolute temperature;

g=Gravitational constant;

df=Liquid fuel density;

(VD)=Engine displacement per cylinder;

(Ev)=Engine volumetric efficiency, fractional;

(PTR)=Ratio of gas pressure cycler pressure above intake manifold pressure, divided by liquid fuel chamber pressure above intake manifold pressure;

$$(CRC) = \frac{(VDC) + (VCLC)}{(VCLC)}$$

(VDC)=Displacement volume of the gas pressure cycler;

(VCLC)=Clearance volume of the gas pressure cycler;

(MCO)=Air mass inside gas pressure cycler at start of cycle of pressure increase followed by pressure decrease;

$$(MCO) = \frac{(MAP)(VDC + VCLC)}{(RTo)}$$

(MAP)=Engine intake manifold absolute pressure and pressure inside gas pressure cycler at start of cycle of pressure increase and decrease;

(RPM)—Engine crankshaft rotational speed;

Any consistent system of units can be used in this equation.

The bleed mass quantity (MB) is adjusted by adjusting the number of times the bleed valve is opened, during each gas pressure cycler pressure rise, and by adjusting the duration of each such bleed valve opening. Approximate relations for (MB) in terms of the duration of each bleed valve opening, (TIB), assumed constant, and the number of bleed valve openings per cycle, (BN), can be used for preliminary design purposes as follows, for the case of a single bleed volume as shown in FIG. 1:

$$(MB)=(Z)(BN)(TIB)(MAP)[(FA)(PTR)(EF)+1] \quad \text{Eqn. V}$$

Wherein:

(BN)=Number of bleed valve openings during each gas pressure cycler pressure rise, and also the number of separate bleed flow masses per cycle, assumed essentially uniformly distributed in time during the pressure increase portion of the cycle;

(TIB)=Time duration of each bleed valve opening;

(FA)=Average factor for average absolute pressure in gas pressure cycler assuming critical gas flow through the bleed orifice;

(FA)=Approximately 0.5 for a single bleed volume and orifice;

$$(Z) = \frac{(KB)(AB)(CB)}{(\sqrt{TF})}$$

(KB)=Critical flow constant for air;

(AB)=Area of the bleed orifice;

(CB)=Bleed orifice flow coefficient;

(TF)=Absolute temperature of bleed air;

Where two or more bleed volumes are used with separate bleed valves and orifices, the relation of bleed mass, (MB), to the number and duration of bleed valve openings depends upon the number of bleed volumes being used, (N), and the sequence in which these volumes are used. For example, where N bleed volumes are being used, in a cascade sequence of one bleed volume at a time, the following approximate relation for total bleed mass can be used:

$$(MB)=Z(TIB)(MAP)(BNO)(W) \quad \text{Eqn. VI}$$

Wherein:

(BNO)=Number of bleed masses bled into one bleed volume during each gas pressure cycler pressure increase, assumed equal for all bleed volumes used;

$$\left[1 + (PTR)(EF)\frac{N}{2}\right] = W$$

Number of bleed volumes used in the sequence;

=N

As another example, N bleed volumes can be used in an increasing cascade, starting with one bleed volume, and adding one additional bleed volume after each cascade time interval, until all N bleed volumes are being used toward the end of each gas pressure cycler pressure increase. For this increasing cascade sequence the following approximate relation for total bleed mass can be used:

$$(MB) = (Z)(TIB)(MAP)\left(\frac{BNL}{2}\right)[X + Y] \qquad \text{Eqn. VII}$$

Wherein:

(BNL)=Number of bleed masses bled into the one last bleed volume during each gas pressure cycler pressure increase; also the number of separate bleed masses bled into one bleed volume during one cascade time interval;

A cascade time interval is defined as the interval when the number of bleed volumes being used remains constant.

$$X = (N)(N + 1)$$

$$Y = \left[N^2 - \frac{(N-1)(2N-1)}{6}\right](PTR)(EF)$$

Any consistent system of units can be used in these equations. These equations are approximate and subject to the errors inherent in the several assumptions mentioned above.

These relations for two or more bleed volumes, used in a cascade sequence, are only example cases. There are a great many different ways in which two or more bleed volumes can be used in sequence. Nor is it necessary that the number of bleed valve openings be uniformly distributed throughout each cascade time interval. Neither is it necessary that the duration of each bleed valve opening be constant. Indeed for some applications it may be preferable to adjust the duration of some of the bleed valve openings in response to changes in engine operating conditions.

The product of the number of bleed masses bled into one bleed volume, times the time duration of each bleed valve opening, during a single cascade time interval, cannot exceed the duration of the cascade time interval:

$$(BNL)(TIB) \leq \frac{15U}{RPM}; \text{ in seconds;} \qquad \text{Eqn. II}$$

Wherein U is the fraction of the duration of the cascade time interval during which the bleed valve is open:

$$O \leqq U \leqq 1$$

For engines operated at higher speeds, and over a wide range of engine intake manifold pressures, two or more bleed volumes may be needed in order to bleed off the necessary total bleed mass, MB, within the available time of the gas pressure cycler pressure increase.

The function of the return flow passage, 90, and check valve, 91, is to restore the bleed mass into the gas pressure cycler during pressure decrease in order to maintain an approximate symmetry of the cycle of pressure increase and decrease of the gas pressure cycler, 23, corresponding to the approximate symmetry of air flow rate into the engine cylinder during the engine intake stroke. In this way an essentially constant ratio of instantaneous intake air flow rate to instantaneous liquid fuel flow rate can be obtained throughout each engine intake stroke, as may be preferred.

C. Use of Several Bleed Volumes

The bleed mass, MB, increases and decreases oppositely to the engine intake air mass. At low intake air mass a large bleed mass must be stored in the bleed volumes, during pressure increase, and then returned into the gas pressure cycler during pressure decrease. Since bleed volume pressure is necessarily less than gas pressure cycler pressure, a large bleed volume is required for this storage when gas pressure cycler pressures are low at low intake air mass. On the other hand, at high intake air mass, a small bleed mass is to be stored in a small bleed volume at higher pressure so that return flow will commence reasonably symmetrically to bleed flow. Thus for engines operated over a wide range of intake manifold pressure, and hence a wide range of torque and intake air mass, we prefer to adjust the portion of the available bleed volume actually being used. At low engine torque a large bleed volume is used, whereas at high engine torque a small bleed volume is used.

In principle a single bleed volume could be used whose volume was adjusted, as needed, via a moveable piston, to change oppositely to engine intake manifold pressure. But a mechanically powerful adjustment drive is needed for this scheme, which is complex and costly.

The compensators of this invention can use several separate bleed volumes, each with separate bleed valve and return flow passage and check valve, as a means for adjusting the bleed volume being used. Bleed volume is increased by opening more of the separate bleed valves, thus increasing the number, N, of bleed volumes being used. Bleed volume, and N, are decreased by opening fewer of the separate bleed valves. Hence bleed volume is thusly adjusted in steps by the controller, 94, selecting the number, N, of bleed volumes to be used, in response to the engine intake manifold pressure sensor, 92, input, as shown in FIG. 2, where two separate bleed volumes, 85, 95, are available. The second bleed volume, 95, has a bleed valve, 106, with driver, 110, bleed orifice, 107, return flow passage, 108, with check valve, 109, similar in design and operation to these same type elements for the first bleed volume, 85.

Any one bleed volume commences return flow only when pressure in the gas pressure cycler has decreased to the pressure in that one bleed volume. Thus symmetry of the cycle of pressure increase and decrease can be improved by using many more separate bleed volumes, whose final separate pressures are all different. For example, if a very large number of separate bleed volumes are used in a one at a time cascade sequence, with each bleed volume receiving a small bleed mass, the return flow can restore very nearly perfect symmetry to each cycle. But such a large number of bleed volumes and valves increases the complexity and cost of the compensator. Generally adequate symmetry of the cycle of pressure increase and decrease can be achieved by use of fewer bleed volumes in an increasing cascade sequence.

The schedule of the number, N, of bleed volumes to be used, versus the engine intake manifold pressure, MAP, thus depends upon the pressures actually reached in the several bleed volumes, and thus upon the cascade sequence used. This schedule is preferably determined experimentally for the engine and then installed into the controller memory.

For preliminary design and sizing purposes the following approximate relations can be used for compensators having two or more separate bleed volumes, all of equal volume, (VB):

For a one at a time cascade sequence:

$$N = \left[\frac{2(MB)(R)(TB)}{(v)(MAP)(PTR)(EF)(VB)} - 1\right] \quad \text{Eqn. III}$$

For an increasing cascade sequence:

$$N = \left[\frac{(1.5)(MB)(R)(TB)}{(v)(MAP)(PTR)(EF)(VB)} - \tfrac{1}{2}\right] \quad \text{Eqn. IV}$$

Wherein:

(N)=Number of bleed volumes to be used in the sequence, set to the next higher integer;

(VB)=volume of one bleed volume;

(TB)=Temperature of air inside the bleed volume, approximated as constant;

(V)=Ratio of maximum pressure rise to be reached in any bleed volume to the maximum pressure rise reached in the gas pressure cycler;

$$0<V<1$$

For critical air flow through the bleed orifices, $(V) \leqq 0.5$;

Any consistent set of units can be used in these approximate relations.

D. Controller Operation

It is the function of the controller element, 94, to adjust the number of bleed masses, BN, and the duration of each bleed flow, TIB, in order to set the value of total bleed mass, MB, in accord with the engine intake air mass per cycle and the engine speed, so that the overall air to fuel ratio of the intake mixture remains essentially constant over a wide range of engine operating conditions. For this purpose the controller receives at least the following input signals from sensors:

(a) A sensor of engine intake air mass per intake stroke. Commonly this can be a sensor of manifold absolute pressure, MAP, element, 92. Somewhat improved accuracy can be achieved by sensing also the intake air temperature. Alternative intake air mass sensors can also be used as, for example, an intake air mass flow rate sensor plus an engine speed sensor in combination;

(b) A sensor of engine speed, 79, can be any of the several types well known in the art;

(c) An engine intake stroke sensor, 27, 28, senses when the gas pressure cycler, 23, cycle of pressure increase and pressure decrease commences, and the controller, 94, then functions to open bleed valves, 86, only when pressure increase is occurring in the variable volume chamber, 30, of the gas pressure cycler;

The following example illustrates one scheme for controller operation:

(1) Using sensed values of (MAP), (RPM) and known engine size the controller calculates total bleed mass (MB) as by use of approximate equation I:

(2) If more than one bleed volume is available the number to be used (N), is calculated, as by using equation III, or equation IV, as appropriate;

(3) The value of (U) is calculated, as by using equation II, and (N) is increased if (U) approaches a value of 1.0;

(4) The product (BN) (TIB) is calculated, and used to control the bleed valve driver, 87, to open and close the bleed valve, 86, the number of openings, of duration, TIB, needed to remove the required bleed mass, (MB), out of the variable volume chamber, 30, of the gas pressure cycler, 23. For this calculation the following approximate equations can be used:

Equation V for a single bleed volume

Equation VI for a one-at-a-time cascade sequence

Equation VII for an increasing cascade sequence (5) Instead of using the several approximate equations described above, it will be preferable to use experimentally determined values of (EF), MB), (N) and (U), etc., for each particular engine, these experimental values being retained in a memory circuit;

For engines operated at a constant RPM, as in pumping or electric generating service, the above controller operation is feasible. However, for engines operated over a wide range of speed and torque, as in automotive service, it will be difficult to control the manifold fuel injector over the resulting very wide range of values for the engine factor, (EF). For automotive use, for example, the ratio of maximum to minimum values for (EF) could be as large as 200 or more. It may be preferable, in these latter types of engine usage, to use separate controllers for engine torque compensation and for engine speed compensation. One example of such separate controllers is illustrated in FIG. 1 and FIG. 2 and comprises the following:

(6) A controller, 94, for a bleed mass compensator of this invention operates as described hereinabove;

(7) A separate controller, 76, responsive to the engine speed sensor, 79, operates upon the pivoted lever pressure transmitter shown in FIG. 2, to adjust the pressure transmitter pressure ratio (PTR), so that the product, (PTR) $(RPM)^2$ remains essentially constant.

With this example scheme, the bleed mass compensator of this invention adjusts the bleed mass (MB), primarily to compensate for changes in engine intake air mass per stroke, or (MAP). The pivoted lever pressure transmitter adjusts the pressure transmitter pressure ratio (PTR), to compensate for changes in engine (RPM). And these separate adjustments are mechanically multiplied together by the gas pressure cycler pressure acting, via the pivoted lever pressure transmitter, to set the pressure in the liquid fuel chamber, 37. With this arrangement, the product (PTR) (EF), in equation I, varies only as (MAP) varies, and thus the needed range of values of (MB) is small enough to lie within reasonable capabilities of the controller, 94. The controller, 94, will nevertheless need an engine speed sensor, 79, input, or an alternate input of pressure transmitter pressure ratio (PTR), in order to calculate the needed bleed mass (MB) via equation I.

The controller, 94, is preferably and probably necessarily, an electronic controller. Electronic sensors can then be used, and the controller can comprise electronic calculators and memory storage elements as needed, such as are well known in the art of electronic devices.

E. Feedback

Actual intake mixture air to fuel ratios will vary over a certain range of values, due, in part to manufacturing tolerances for the various parts of the manifold fuel injector, and also of the compensators. This range of variation may increase with engine use, due to various changes, such as deposit formations in the engine combustion chamber, or on the intake valve, or elsewhere in the fuel system. To keep this range of variation of air to fuel ratio within acceptable limits it will often be preferable to incorporate a feedback system into the controller of the compensator, responsive to a mixture ratio sensor, and operative via the controller, to adjust the duration of bleed valve opening (TIB), to correct excessive variations of mixture ratio.

An example feedback system is shown schematically in FIG. 1 and FIG. 2 and comprises the following:

1. An exhaust gas composition sensor, 96, in the engine exhaust manifold, 10, senses the operating air to fuel ratio of the engine;
2. This mixture ratio signal is an additional input, 96, to the compensator controller, 94;
3. The controller, 94, adjusts the duration , TIB, of opening of the bleed valve, 86, so that, as sensed engine air fuel ratio becomes richer in fuel than a selected range of values, the duration of each bleed valve opening is increased, and further so that, as sensed engine air fuel ratio becomes leaner in fuel than this selected range of values, the duration of each bleed valve opening is decreased.
4. At present, the most common type of exhaust gas composition sensor is the Zirconia based oxygen content sensor, in wide use in automobiles. Improved feedback response time could be obtained if the air to fuel ratio could be sensed in the engine intake manifold, 9, instead of in the engine exhaust manifold, 10. Where fuel evaporation is essentially complete within the intake manifold, the resulting air temperature drop could, in principle, be used as an air to fuel ratio sensor.
5. The adjustments made by the controller in response to the feedback signal are preferably to the duration of bleed valve opening (TIB), rather than to the number of bleed valve openings (BN), since the latter can only be varied in integral steps.

F. Series Bleed Valves

An example of a modified form of compensator of this invention is shown in FIG. 3 and comprises:

1. At least two separate bleed volumes, 85, 95, with return flow passages, 90, 97, and check valves, 91, 98, are used, and these function as described hereinabove for the FIG. 2 form of compensator;
2. Each bleed volume, 85, 95, and connected bleed orifice, 88, 99, has a separate first bleed value, 100, 101, with drives, 102, 103;
3. The first bleed valves, 100, 101, connect to the variable volume chamber, 30, of the gas pressure cycler, 23, via a single second bleed valve, 104, with driver, 105;
4. The controller, 94, operates upon the first bleed valves, 100, 101, drivers 102, 103, to select the number, N, of these first bleed valves to be opened during each pressure increase of the gas pressure cycler, 23, and to hold these first bleed valves open throughout each pressure increase;
5. The controller, 94, operates upon the single second bleed valve, 104, driver 105, so that the second bleed valve is opened only during each gas pressure cycler pressure rise, and so that the product of the number of second bleed valve openings times the duration of each valve opening during each pressure rise, increases as engine intake pressure, MAP, decreases, and decreases as engine intake pressure increases;
6. With this FIG. 3 form of compensator, the several first bleed valves, 100, 101, are thus used only to select the number of bleed volumes, 85, 95, to be used, and these valves and drivers can be of a simpler design. The adjustment of the number of bleed time intervals and the duration thereof is carried out by the single second bleed valve, 104, and thus only one of this more complex valve is needed and this is an advantage of this FIG. 3 form of compensator over the FIG. 2 form;
7. A disadvantage of the FIG. 3 form of compensator is that one more valve is needed over the number needed for the FIG. 2 form;

The several example forms of compensators for manifold fuel injectors are described hereinabove for illustrative purposes, and it is not intended thereby to limit the scope of the invention to these particular examples.

By creating stratified air fuel mixtures within each intake mixture mass for each engine cycle, the occurrence of engine knock can be suppressed, as is described in U.S. Pat. No. 4,425,892, and this material is incorporated herein by reference thereto. Examples of apparatus for creating such stratified air fuel mixtures, using intake manifold fuel injectors, are described in U.S. Pat. No. 5,456,232, and U.S. Pat. No. 5,483,937, and this material is incorporated herein by reference thereto. Such intake stratifier means can also be used in combination with the compensators of this invention.

Having thus described my invention, what I claim is:

1. In a four stroke cycle internal combustion engine mechanism comprising: at least one piston, operative within a cylinder, and connected to a crankshaft via a connecting rod; each said piston and cylinder comprising a variable volume chamber, between the crown of said piston and the head of said cylinder, whose volume varies when said piston is moved by said connecting rod within said cylinder by rotation of said crankshaft; an air intake valve and an exhaust valve gas flow connecting into said variable volume chamber and opened and closed by a valve drive means from said crankshaft; said valve drive means being timed relative to said piston so that a four stroke cycle is carried out with each two revolutions of said crankshaft; said four stroke cycle comprising in time order, an air intake stroke whenever said piston is moving to increase the volume of said variable volume chamber and said intake valve is opened and said exhaust valve is closed by said valve drive means, a compression stroke whenever said piston is moving to decrease the volume of said variable volume chamber and said intake and exhaust valve are closed by said drive means, an expansion stroke whenever said piston is moving to increase the volume of said variable volume chamber and said intake valve and said exhaust valve are closed by said valve drive means, a combustion process occurring during the ending of said compression stroke and the starting of said expansion stroke when fuel is supplied to said internal combustion engine mechanism, an exhaust stroke whenever said piston is moving to decrease the volume of said variable volume chamber and said exhaust valve is opened and said intake valve is closed by said valve drive means, and said four stroke cycle is repeated; an air supply manifold connection to said air intake valve; an exhaust gas manifold connection to said exhaust valve; a source of supply of engine liquid fuel at a pressure in excess of atmospheric; an ignition means for igniting compressed fuel air mixtures within said variable volume chamber so that a combustion process occurs during said compression and expansion strokes; an engine intake air density adjustment means for adjusting the density of the air in said air intake manifold;

said four stroke cycle internal combustion engine mechanism further comprising engine fuel injection systems wherein each said piston and cylinder is served by one such engine fuel injection system, each said engine fuel injection system comprising:

a gas pressure cycling means for cycling the pressure of a gas quantity so that during each cycle said gas pressure rises from a starting pressure to a peak pressure and said pressure rise is followed by a pressure decrease from said peak pressure to essentially said starting pressure; said gas pressure cycling means comprising a variable volume chamber, containing said gas quantity, enclosed between a fixed container and a moveable element operating sealably within said fixed container, pressure cycler means for driving said moveable element so that said variable volume is decreased to increase the pressure of said gas quantity and is subsequently increased to decrease the pressure of said gas quantity and to thusly cycle the pressure of said gas quantity, first means for connecting said variable volume chamber to said engine air supply manifold only during the ending of said pressure decrease and the start of the next said pressure increase so that said starting pressure essentially equals the pressure in said engine air supply manifold;

fuel injector means for injecting liquid fuel into said engine air supply manifold during each said air intake stroke and comprising: a fuel injector nozzle, a liquid fuel chamber containing liquid fuel, a nozzle valve means for connecting and disconnecting said fuel injector nozzle to said liquid fuel chamber and comprising drive means for opening and closing said nozzle valve means, a fuel supply valve means for connecting and disconnecting said liquid fuel chamber to said engine fuel supply source and comprising drive means for opening closing said fuel supply valve means, a liquid fuel pressurizer means for applying pressure to said liquid fuel in said liquid chamber;

said fuel injector nozzle of said fuel injector means connecting into said engine air supply manifold;

pressure transmitter means for transmitting pressure from said variable volume chamber of said gas pressure cycling means to said liquid fuel pressurizer means of said fuel injector means so that pressure rise in said variable volume chamber of said gas pressure cycling means is transmitted as pressure increase on said liquid fuel in said liquid fuel chamber, and so that pressure decrease in said variable volume chamber is transmitted as pressure decrease on said liquid fuel, and so that gas does not enter said liquid fuel chamber and so that liquid fuel does not enter said variable volume chamber of said gas pressure cycling means;

means for connecting and disconnecting the pressure, generated in said variable volume chamber of said gas pressure cycler, to said pressure transmitter so that pressure increase and decrease act upon said pressure transmitter only during and throughout each said air intake stroke;

inter drive means for driving said pressure cycler drive means for driving said moveable element of said gas pressure cycling means from said crankshaft of said internal combustion engine mechanism so that, a pressure cycle takes place during each said air intake stroke, and so that the duration of said pressure cycle is essentially equal to the duration of said intake stroke;

intake stroke sensor means for sensing the start of said air intake stroke and the end of said air intake stroke of said internal combustion engine mechanism;

fuel valve control means for controlling the connecting and disconnecting of said fuel injector nozzle to said liquid fuel chamber and for controlling the connecting and disconnecting of said liquid fuel chamber to said engine fuel supply source, and responsive to said intake stroke sensor means, and operative upon said nozzle valve means drive means and said fuel supply valve drive means, so that said nozzle valve means connects said fuel injector nozzle to said liquid fuel chamber only from essentially the start to the end of each said air intake stroke, and so that said fuel supply valve means connects said liquid fuel chamber to said engine fuel supply source only when said nozzle valve means has disconnected said fuel injector nozzle from said liquid fuel chamber;

wherein the improvement comprises adding to each said gas pressure cycling means, of each said engine fuel injection system, a manifold fuel injector compensator comprising:

at least one bleed volume enclosed within a pressure vessel container;

bleed flow passages, from said variable volume chamber of said gas pressure cycling means, separately to each said bleed volume;

bleed orifices in each said separate bleed flow passage to each said bleed volume;

first bleed valves in each said separate bleed flow passage to each said bleed volume, each said bleed valve comprising drive means for opening and closing said bleed valve;

gas pressure cycler pressure rise sensor means for sensing when pressure increase occurs in said variable volume chamber of said gas pressure cycler means;

return flow passages, separately from each said bleed volume to said variable volume chamber of said gas pressure cycling means, each said return flow passage comprising unidirectional flow means for creating unidirectional flow in said return flow passage, so that flow can occur only from said bleed volume into said variable volume chamber of said gas pressure cycling means;

an engine intake air mass sensor means for sensing the air quantity going into each engine cylinder during each engine intake stroke;

a controller means for controlling the opening and closing of said first bleed valves, responsive to said engine intake air mass sensor means, and said gas pressure cycler pressure rise sensor means, and operative upon said first bleed valves drive means, so that, said first bleed valves are opened only during each gas pressure cycler pressure rise, and so that the product of the number of times said first bleed valves are opened multiplied by the duration of each said opening, increases as the air quantity going into each engine cylinder during an intake stroke decreases, and decreases as said air quantity increases.

2. In a four stroke cycle internal combustion engine comprising a fuel injection system as described in claim 1:

wherein said controller means is operative upon said first bleed valves so that, during each gas pressure cycler pressure rise, the number of said first bleed valve openings increases as the air quantity going into each engine cylinder during each air intake stroke decreases, and decreases as said air quantity increases.

3. In a four stroke cycle internal combustion engine comprising a fuel injection system as described in claim 1:

wherein said internal combustion engine is intended to be operated within a selected range of values for the overall ratio of air to fuel, of the air fuel mixture taken into each engine cylinder during each intake stroke;

and further comprising:

mixture sensor means for sensing the difference between said selected range of values of overall ratio of air to fuel, and the overall ratio of air to fuel of said air fuel mixture taken into each engine cylinder;

wherein said controller means is additionally responsive to said mixture sensor means, and is further operative upon said first bleed valve drive means, so that: the duration of each said bleed valve opening, of those first bleed valves opened, during each gas pressure cycler pressure rise increases as said air to fuel ratio of said mixture taken into each engine cylinder becomes richer in fuel than said selected range of overall air to fuel ratio, and decreases as said air to fuel ratio of said mixture taken into each engine cylinder becomes leaner in fuel than said selected range of overall air to fuel ratio.

4. In a four stroke cycle internal combustion engine comprising a fuel injection system as described in claim 1:

wherein said manifold fuel injector compensator comprises at least two of said bleed volumes;

and further comprising:

an additional second bleed valve, comprising drive means for opening and closing said second bleed valve, and connected between said variable volume chamber of said gas pressure cycler means and said first bleed valves in said separate bleed flow passages;

wherein said controller means is operative upon said first bleed valves so that, during each gas pressure cycler pressure rise, the number of said first bleed valve openings increases as the air quantity going into each engine cylinder during each air intake stroke decreases, and decreases as said air quantity increases;

and further wherein said controller means is additionally operative upon said second bleed valve drive means, so that said second bleed valve is opened only during each gas pressure cycler pressure rise, and so that during each gas pressure cycler pressure rise, the product of the number of times said second bleed valve is opened multiplied by the duration of each said second bleed valve opening, increases as the air quantity going into each engine cylinder during an intake stroke decreases, and decreases as said air quantity increases.

5. In a four stroke cycle internal combustion engine comprising a fuel injection system as described in claim 4:

wherein said internal combustion engine is intended to be operated within a selected range of values for the overall ratio of air to fuel, of the air fuel mixture taken into each engine cylinder during each intake stroke;

and further comprising:

mixture sensor means for sensing the difference between, said selected range of values of overall ratio of air to fuel, and the overall ratio of air to fuel of said air fuel mixture taken into each engine cylinder;

wherein said controller means is additionally responsive to said mixture sensor means, and is further operative upon said second bleed valve drive means, so that, during each gas pressure cycler pressure rise, the duration of each second bleed valve opening increases as the air to fuel ratio of said mixture taken into each engine cylinder becomes richer in fuel than said selected range of overall air to fuel ratio, and decreases as said air to fuel ratio of said mixture taken into each engine cylinder becomes leaner in fuel than said selected range of overall air to fuel ratio.

6. In a four stroke cycle internal combustion engine comprising a fuel injection system as described in claim 1:

and further comprising an engine speed sensor;

wherein said controller means is additionally responsive to said engine speed sensor, and is additionally operative upon said first bleed valve drive means, so that, during each gas pressure cycler pressure rise, the number of said first bleed valves opened increases as engine speed decreases, and decreases as engine speed increases, and so that, for those bleed valves which are opened, the product of the number of times each said first bleed valve is opened multiplied by the duration of each said opening, increases as engine speed decreases, and decreases as engine speed increases.

7. In a four stroke cycle internal combustion engine comprising a fuel injection system as described in claim 4:

and further comprising an engine speed sensor;

wherein said controller means is additionally responsive to said engine speed sensor, and is additionally operative upon said second bleed valve drive means, so that, during each gas pressure cycler pressure rise, the product of the number of times said second bleed valve is opened multiplied by the duration of each said opening, increases as engine speed decreases, and decreases as engine speed increases.

8. In a four stroke cycle internal combustion engine comprising a fuel injection system as described in claim 1:

wherein said liquid fuel pressurizer means of said fuel injector means comprises a liquid piston acting sealably on one side upon said liquid fuel within said liquid fuel chamber, the opposite side of said liquid piston being connected to said engine air supply manifold;

wherein said pressure transmitter means comprises: a gas piston acted on one side sealably by said gas quantity within said variable volume chamber of said gas pressure cycling means; the opposite side of said gas piston being connected to said engine air supply manifold;

wherein said pressure transmitter means further comprises:

pivoted lever means for transmitting force from said gas piston to said liquid piston of said liquid fuel pressurizer and comprising a pivot, so that; whenever the gas pressure acting on the variable volume chamber side of said gas piston changes, the liquid pressure of said liquid fuel within said liquid fuel chamber of said fuel injector means changes in the same direction; and so that; the ratio of said net gas pressure to said net liquid pressure remains essentially constant when said pivot of said pivoted lever means is fixed relative to said gas piston and said liquid piston;

wherein said pivot of said pivoted lever means comprises pivot adjustment means for adjusting the position of said pivot relative to said gas piston and said liquid piston so that the ratio of said net gas pressure of the gas quantity within said variable volume of said gas pressure cycling means to said net liquid pressure of said liquid fuel within said liquid fuel chamber of said fuel injector means can be changed, said pivot adjustment means comprising pivot drive means for moving the pivot;

and further comprising an engine speed sensor;

and further comprising second controller means for controlling said pivot drive means, responsive to said engine speed sensor, and operative upon said pivot drive means, so that, as engine speed increases said pivot is moved toward said liquid piston, and as engine speed decreases said pivot is moved toward said gas piston.

9. In a four stroke cycle internal combustion engine comprising a fuel injection system as described in claim 4:

wherein said liquid fuel pressurizer means of said fuel injector means comprises a liquid piston acting sealably on one side upon said liquid fuel within said liquid fuel chamber, the opposite side of said liquid piston being connected to said engine air supply manifold;

wherein said pressure transmitter means comprises: a gas piston acted on one side sealably by said gas quantity within said variable volume chamber of said gas pressure cycling means; the opposite side of said gas piston being connected to said engine air supply manifold;

wherein said pressure transmitter means further comprises:

pivoted lever means for transmitting force from said gas piston to said liquid piston of said liquid fuel pressurizer and comprising a pivot, so that; whenever the gas pressure acting on the variable volume chamber side of said gas piston changes, the liquid pressure of said liquid fuel within said liquid fuel chamber of said fuel injector means changes in the same direction; and so that; the ratio of said net gas pressure to said net liquid pressure remains essentially constant when said pivot of said pivoted lever means is fixed relative to said gas piston and said liquid piston;

wherein said pivot of said pivoted lever means comprises pivot adjustment means for adjusting the position of said pivot relative to said gas piston and said liquid piston so that the ratio of said net gas pressure of the gas quantity within said variable volume of said gas pressure cycling means to said net liquid pressure of said liquid fuel within said liquid fuel chamber of said fuel injector means can be changed, said pivot adjustment means comprising pivot drive means for moving the pivot;

and further comprising an engine speed sensor;

and further comprising second controller means for controlling said pivot drive means, responsive to said engine speed sensor, and operative upon said pivot drive means, so that, as engine speed increases said pivot is moved toward said liquid piston, and as engine speed decreases said pivot is moved toward said gas piston.

* * * * *